United States Patent [19]

Haslam et al.

[11] Patent Number: 4,608,806

[45] Date of Patent: Sep. 2, 1986

[54] CAPPING MACHINES

[75] Inventors: James K. Haslam, Wimborne; Sidney W. Waters, Poole, both of England

[73] Assignee: Metal Box plc, Berkshire, England

[21] Appl. No.: 521,107

[22] Filed: Aug. 8, 1983

[30] Foreign Application Priority Data

Aug. 17, 1982 [GB] United Kingdom ..... 8223653

[51] Int. Cl.[4] ..... B67B 3/20

[52] U.S. Cl. ..... 53/314; 53/317; 53/368

[58] Field of Search ..... 53/306, 313, 314, 315, 53/316, 317, 329, 331, 368; 198/627, 628

[56] References Cited

U.S. PATENT DOCUMENTS

| | | | |
|---|---|---|---|
| 2,256,415 | 9/1941 | Stewart | 53/314 X |
| 2,319,214 | 5/1943 | Davies | 53/329 X |
| 2,876,605 | 3/1959 | McElroy et al. | 53/315 |
| 3,054,234 | 9/1962 | Stover | 53/490 |
| 3,071,909 | 1/1963 | Elleman | 53/315 |
| 3,274,748 | 9/1966 | Roberts et al. | 53/490 |
| 3,438,174 | 4/1969 | Foss et al. | 53/314 X |
| 3,559,365 | 2/1971 | Hull et al. | 53/490 |
| 3,803,800 | 4/1974 | Tavernier | 53/306 X |
| 3,905,177 | 9/1975 | Herzog | 53/314 |
| 4,279,115 | 7/1981 | Roberts et al. | 53/490 |

FOREIGN PATENT DOCUMENTS

| | | | |
|---|---|---|---|
| 597618 | 5/1960 | Canada . | |
| 394480 | 6/1933 | United Kingdom . | |
| 646441 | 11/1950 | United Kingdom . | |
| 1111233 | 4/1968 | United Kingdom . | |
| 0571432 | 9/1977 | U.S.S.R. | 53/313 |

*Primary Examiner*—E. R. Kazenske
*Assistant Examiner*—Michael D. Folkerts
*Attorney, Agent, or Firm*—Scully, Scott, Murphy & Presser

[57] ABSTRACT

A capping machine for applying removable closures to bottles, jars or other containers has a capping head cantilevered (without other support) from a post rising from the machine base, the capping head height being infinitely variable by simple adjustment. The side belts which engage the containers are also infinitely variable for height, being carried by a parallelogram structure pivoted on the capping head body and adjustable by means of a single nut. The cap chute has a pair of retractable rollers to locate the closures at the pick-up point, these rollers being mounted on tension-spring biased cranked levers so pivoted that their lever arm, for movement of the roller axes, makes only a small acute angle with the path of the closures. The sealing shoe is suspended in the capping head by a pair of levers which permit the shoe to rock in a vertical plane.

21 Claims, 12 Drawing Figures

CAPPING MACHINES

FIELD OF THE INVENTION

This invention relates to capping machines, that is to say machines for applying, to a succession of containers, closure members which are usually in the form of removable caps of various kinds, and which for convenience will be referred to herein by the generic term "caps".

The containers may be for example in the form of bottles, jars or cans, and may be manufactured from any suitable material such as glass, plastics, paperboard or metal. As to the caps, these may be of any suitable material and will typically be of metal, though they may for example be of plastics materials.

BACKGROUND OF THE INVENTION

Caps may be of any one of a number of different kinds. For example, they may be of the familiar type which is removed from the container by twisting the cap through part of one turn so as to release a plurality of locking projections of the cap from corresponding retaining means formed about the mouth of the container. These caps can be referred to as "twist-off caps", as distinct from another type which is the screw cap. A screw cap has to be unscrewed in order to remove it from the container, (usually by at least one full revolution of rotation), and most screw caps are applied to the containers by screwing them on to the latter by rotation through the same number of revolutions in the opposite direction. Twist-off caps may be applied by similar reverse rotation; but they may alternatively be adapted to be secured to the containers by applying to the cap a simple axial force which pushes the cap into position, the cap or the container or both (but usually the cap) having suitable resilience to allow the locking projection or projections to be deformed during this operation and to spring into their locking condition when the cap is fully home on the container. Such a cap may be referred to as a "push-on, twist-off" cap.

A further kind of cap which is secured to the container by application of a simple axial force is that of the so-called "pry-off" type which is removed by upward leverage so that it springs off the container without any rotational movement.

The invention is particularly concerned with capping machines capable of applying, at high speed, a succession of caps to a succession of respective containers, the caps being for example of any of the kinds discussed above. Such machines are to be found in the filling plants of manufacturers of products such as foodstuffs, beverages and other flowable substances. In the case of many products it is required that the product be vacuum packed, i.e. the filled container, as yet uncapped, is passed into an enclosure in which the air pressure is lower than the ambient pressure. The cap is secured to the container within this enclosure, so that on emerging from the enclosure, the filled and sealed container contains, above the product therein, a partial vacuum. The term "vacuum", when used herein, is to be understood to mean such a partial vacuum.

There are a number of problems today encountered in connection with the use of high-speed capping machines for capping large quantities of containers. One such problem arises from the fact that successive batches of a product may be required to be packed in containers of different capacities. Thus, for example, one batch may be packed in jars of a particular height, and the next in jars which are of lesser height. Conventionally the jars are passed through the capping machine on a linear conveyor moving horizontally. In order to apply the caps, cap-applying means of the machine are set at the appropriate working height above the conveyor, and consequently have to be re-set to a different working height when the height of the jars is changed. This normally entails the removal of certain parts of the machine and their replacement by "change parts" having different dimensions, in order to achieve the required versatility.

A typical capping machine has a cap-applying or capping head mounted above the conveyor, the capping head being arranged to place a cap upon each container in turn at a feed or pick-up station, and to secure or seal the cap to the container at a subsequent sealing station. To this end the capping head includes a capping head body, carrying a cap chute at the pick-up station and sealing means at the sealing station. Conventionally, the capping head is mounted above the conveyor by means of appropriate vertical supports at both sides of the conveyor. To adjust the vertical position of the capping head above the conveyor (the "head height") it is necessary to provide change parts in the form of these supports of different lengths.

The cap chute must be capable of accurately positioning each cap in turn so that the appropriate container will engage the cap in the correct orientation and centrally. Accordingly the cap chute comprises a pair of guide rails, along which the caps are fed, and which in the pick-up position are separated, transversely of the path of the containers, by an amount approximating to the diameter of the cap so as to hold the latter in its correct position.

The cap chute conventionally has some means for arresting each cap in turn, and for retaining it temporarily, in its pick-up position. Such arresting and retaining means has to be such that, when the cap is engaged by a leading upper portion of the approaching container, the cap can then be advanced past the retaining means without difficulty, and particularly without applying to the cap any force that might lift or jerk it off the container or out of its correct position upon the latter. Numerous arresting and retaining means for this purpose have been proposed in the past, and a number of them have been used successfully in production. Some of these prior art cap chutes involve moving parts, usually spring-loaded; others rely on particular features of the geometry of the fixed cap guide rails of the cap chute, such as a "step" over which the cap is lifted by the container as it comes into engagement therewith (see for example United Kingdom patent specification No. GB-A-1408535). In pursuit of higher operating speeds, however, it becomes desirable to minimise the forces applied to the cap as much as possible; whilst in the interests of reliability and ease of maintenance it is equally desirable to ensure that the components are as simple and accessible as possible.

In one particular form of prior art cap chute, described in United Kingdom patent specification No. GB-A-2040892, the arresting and retaining means of the cap chute comprises a pair of stop pins extending towards each other, transversely of the path of the caps, each stop pin being mounted in a housing formed integrally in a side guide wall of a respective one of the cap guide rails of the chute, and biased into its extended position by a compression spring concealed within the housing. When the cap is engaged by a container, for example by the leading portion of the terminal lip of a glass jar coming into contact with the interior of the leading portion of the cap skirt, the cap is pushed forward by the advancing container so as to force the stop pins to retract against the action of their springs. Not only may some considerable force be required to retract the springs, but the force so applied may result in some cases in "rebound" so that the springs may tend to apply an impulse to the stop pins such as to hit the cap and lift it from the container. In any event, the use of captive compression springs results in the need to stop the capping machine, and to remove and dismantle the whole cap chute, when it becomes necessary to replace the springs, an operation that is required at frequent intervals.

It is of course necessary that the containers be correctly centred with respect to a longitudinal centre plane of their path along the conveyor of the capping machine, and also that they be positively driven along this path. Whilst the moving conveyor does advance the containers mounted on it, and could be provided with dogs or other pushing devices for applying a positive forward driving force to them, there is always a danger of the containers toppling when subjected to forces at their upper ends during the capping operations of placing the cap upon the container, (cap placement), and subsequently of sealing the container. For these reasons it is conventional practice to provide a pair of endless belts above the level of the conveyor, one belt to each side. The belts advance at the same forward velocity as the conveyor, and grip the containers between them so as to urge the latter forward whilst at the same time automatically providing the required centralisation of the containers and also preventing the latter from toppling either forwards or sideways.

These side belts must engage a portion of each container so shaped as to enable the belts to exert a sufficient frictional force on the container. Most bottles or jars are of circular cross-section in plan (though it should be noted that this invention is not confined to applications in connection with containers of such cross-section). The side belts should engage upon a portion of the container which is cylindrical or nearly cylindrical, or which for some other reason is so shaped in elevation that the belts can satisfactorily grip without any tendency, for example, to slip upwardly or downwardly. Such upward or downward slippage would for example tend to occur if the greater part of the container is in the form of part of a sphere and the side belts are engaged on the spherical surface. It is accordingly necessary, if the capping machine is to be adapted to handle containers of multifarious shapes, to provide means whereby the height at which the side belts are set above the conveyor may be chosen for its suitability for any particular shape of container, i.e. so that the belts will engage that part of the container best suited for the purpose.

Adjustment of side belt height is also necessary in the case, discussed above in another connection, in which batches of containers of different heights (as between one batch and another) are to be handled by the capping machine. Conventionally, this adjustment is achieved by providing three sets of side belt brackets as change parts. The side belts are suitably mounted on these brackets, and each set of the latter is so dimensioned as to determine a different one of three heights of side belt above the conveyor.

Changing the side belt brackets is a fairly major operation, calling for a considerable amount of dismantling, re-assembly, and re-adjustment before the capping machine can be put into productive use again. The higher the speed at which the machine is designed to operate, the more expensive in terms of lost operating time is the period of inaction whilst side belt brackets are changed. In addition, the additional costs of acquiring and storing change parts are a serious disadvantage. These and other well-known disadvantages do of course apply wherever provision of change parts are necessary.

It is however necessary that side belts, at whatever height, should be accurately positioned, both as to the transverse spacing between them and as to their parallelism with respect to the conveyor.

At the sealing station, the cap is secured to the container by sealing means which applies an axial force to the cap (with or without any necessary rotational movement) according to the type of cap being applied.

The sealing means of the capping machine applies downward axial pressure on the cap which has been placed upon the container at the pick-up point, by means of a sealing shoe, which is biassed downwardly by a spring or springs to provide the necessary axial sealing force. The sealing shoe may also be provided with means for heating the shoe and consequently the cap if the latter is of a kind requiring such heating. Underlying the sealing shoe, and in contact with it, is at least one sealing belt in the form of an endless belt, which is driven at a predetermined speed, preferably deriving its motion from the same motor that drives the conveyor and side belts. The sealing belt assists the forward movement of the container, and ensures that the cap remains placed upon the latter until it has been moved axially downwards so that it can no longer be pushed off the container in a direction having a radial component. Where twisting action is also required in order to effect securing of the cap upon the container (as is for example the case with a screw cap or a twist-off cap of the kind which is not adapted to be pushed on to the container by application of a simple axial force), two sealing belts are provided. The two sealing belts are driven at different speeds; and both engage the top of the cap simultaneously. Thus the cap is turned about its axis whilst being pushed down on the container.

Particularly in high-speed operation, it is desirable to ensure very smooth and accurately controlled vertical movement of the sealing shoe, whilst at the same time preventing any sideways or forward movement of the shoe in a horizontal plane.

DISCUSSION OF THE INVENTION

According to the invention, in a first aspect, there is provided a capping machine for applying removable closure members to containers and including container-advancing means for moving the containers in succession in a generally-horizontal longitudinal forward direction, the machine having container support means for supporting the containers thereon during their forward movement, and a capping head above the container support means, the capping head having a body and including also a pair of elongate, longitudinally-extending side support members for engaging the containers between them during the said forward movement, wherein the capping head includes a parallelogram-type structure comprising a lower longitudinal portion including the side support members, a pair of end portions each pivoted to the lower longitudinal portion and each pivotally mounted on the capping head body about a transverse axis, and an upper longitudinal portion pivotally connected to and between the end portions, the capping head further including securing means for securing the parallelogram-type structure in a predetermined altitude with respect to the capping head body, and said securing means being adjustable so as to vary at will the said altitude whereby to vary the height of the side support members above the container support means.

This simple parallelogram-type mounting for the side support members enables the latter to be raised or lowered at will, preferably by effecting simple adjustment of the longitudinal position of the upper longitudinal portion of the structure, with respect to the body member of the capping head. Thus, instead of the need for major change parts with their attendant disadvantages, there is provided a simple and quick means for obtaining the desired height of the side support members effecting a single adjustment without any disassembly at all.

Preferably each side support member comprises an endless side belt, the lower longitudinal portion of the parallelogram-type structure carrying at its ends pulleys for said side belts, the machine further including side belt drive means for driving the side belts in a direction such as to urge the containers formed through the machine. Use of a parallelogram linkage ensures that the side belts remain parallel with container support means (e.g. a linear conveyor) at all times, whilst the integrity of the spacing between the two belts can be maintained by, for example, making each end member of the parallelogram linkage in the form of a pair of rigid frames joined, integrally or otherwise, by a rigid cross-member.

Another important advantage of this first aspect of the invention is that, by contrast with the limited choice of side belt height permitted by the use of change parts, the adjustable parallelogram linkage affords infinite variation in side belt heights between the extreme upper and lower ends of the range through which such height is variable.

The side belts are preferably driven by the same motor that drives the conveyor, so as to ensure that they travel at exactly the same forward speed as the latter. Accordingly, the drive is transmitted from the motor to a driven shaft in the capping head, and thence, via a suitable side belt drive transmission means, to the side belt pulleys. Because the latter will assume different positions relative to the driven shaft in the capping head according to the adjustment of side belt height, it is convenient to provide a chain drive as the side belt drive transmission means.

According to the invention, in a second aspect, a cap chute for a capping machine comprises a pair of substantially parallel guide rails for supporting each of a succession of the closure members at a pick-up position, there to be engaged by the rim of an open container passing in a forward longitudinal direction below the cap chute, the latter further comprising a pair of rollers for engaging with their peripheries the sides of the cap at the pick-up position, each roller being mounted for free rotation about its axis in a respective roller arm, and each roller arm being mounted by a pivot at the side of the respective guide rail such that a plane common to the lever arm pivot and the roller axis makes a relatively small acute angle with the direction of forward motion of the closure members, each roller being biassed by a tension spring towards the other roller such that the rollers together constitute a retractable stop for each successive closure member.

The rollers, roller arms and tension springs are exposed so as to be replaceable without disturbance to the remainder of the cap chute. Each roller arm is sufficiently long to enable the cap to push the two rollers apart with minimal force, and to ensure that any possibility of uneven pressure upon the cap is eliminated.

This arrangement also affords considerably improved control of the movement of the cap, since the rollers are in continuous rolling contact with the cap skirt until the cap has moved forward sufficiently to be clear of them. The use of cylindrical rollers also prevents there being any possibility of the cap, or one side of the cap, being dislodged upwardly or tilted; on the contrary, the rollers tend to force the cap to retain a parallel alignment with respect to the conveyor and the top of the container.

According to the invention, in a third aspect, a capping machine for applying removable closures to containers comprises container-advancing means for moving the containers in succession in a generally-horizontal, longitudinal forward direction, means for delivering closure members in succession to place them upon the containers without securing them, and a capping head having a body and including sealing means for subsequently securing each closure member in turn to its container, the sealing means being adapted to apply downward sealing pressure upon each of a succession of the closure members previously placed upon a respective container, the sealing means comprising a sealing shoe which is carried by a pair of suspension arms extending generally in said longitudinal direction and arranged one behind the other in that direction, each suspension arm being pivoted at one end to the capping head body and at the other end to the sealing shoe and being in addition suspended from the capping head body through individual resilient load-applying means connected so as to apply a substantially vertical load to the suspension arm at a point offset longitudinally from the pivot joining the arm to the sealing shoe, whereby the sealing shoe can rock longitudinally under the control of the load-applying means.

Preferably each of the resilient load-applying means comprises a compression spring coupled through a substantially vertical hanger with the respective suspension arm, to which the hanger is pivoted at said point of connection. Each of these compression springs can conveniently be made separately adjustable as to spring pressure, thus enabling particularly sensitive adjustment of the pressure exerted by the sealing shoe on the cap to be effected. Furthermore, this adjustment can be made without upsetting the position of the sealing shoe.

Due to the controlled rocking in a longitudinal plane which this arrangement permits to the sealing shoe, the assembly of sealing shoe and sealing belts tilts backwardly against the rearward spring as an advancing container, carrying a cap, comes into initial engagement with the sealing belts. The sealing operation is effected with the shoe and sealing belts horizontal, this being automatically ensured by the action of the two independent compression springs; and as the capped container reaches the forward end of the shoe, the assembly tilts forwardly to enable the container to be released smoothly. There are with this arrangement substantially no sudden forces applied to the cap or the container by the sealing means.

According to the invention, in a fourth aspect, there is provided a capping machine for applying removable closure members to containers and including container-advancing means for moving the containers in succession in a generally-horizontal, longitudinal forward direction, a machine base having container support means for supporting the containers thereon during their forward movement, and a capping head mounted on the base and arranged above the container support means, the capping head having a body, wherein the capping head body is cantilevered from a single support part mounted on the machine base, the body being movable along the support post so as to vary the height of the capping head above the base, and having locking means to lock it to the support post at any predetermined height, other means mounting the capping head on the base being absent. This arrangement enables the "head height" (discussed earlier herein) to be readily adjusted without any need for change parts.

BRIEF DESCRIPTION

One embodiment of a capping machine according to the invention will now be described, by way of example only, with reference to the drawings of this specification, in which.

Figure 10:
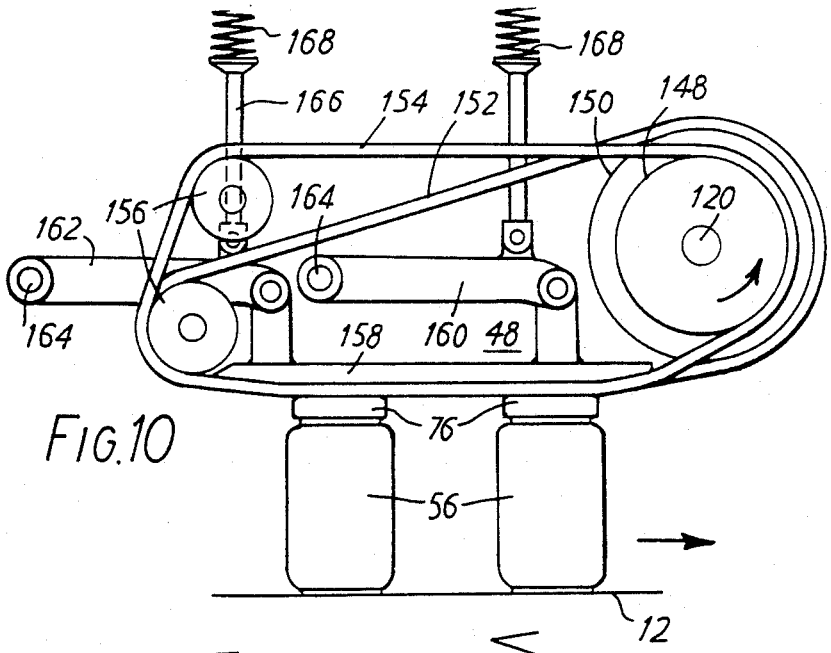
Figure 11A:
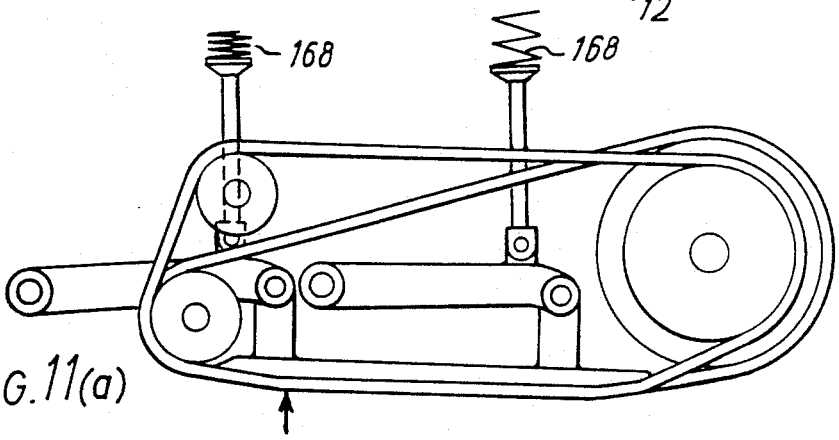
Figure 11B:
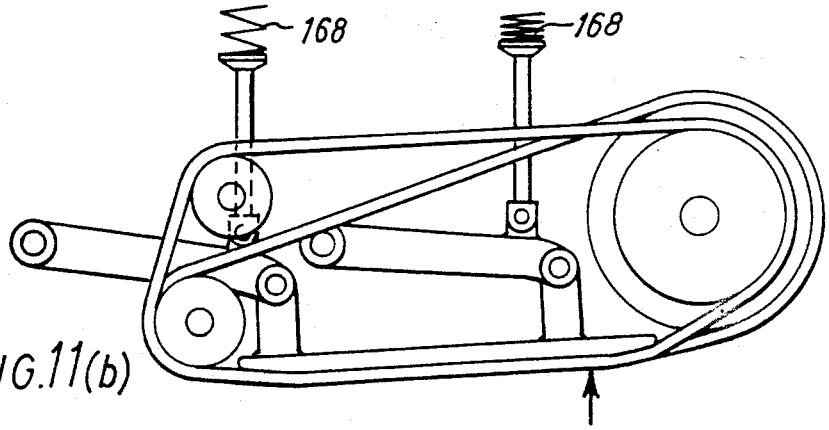

FIG. 10 is a simplified side elevation of the sealing assembly of the capping machine, shown during a sealing operation; and FIG. 11 is similar to FIG. 10 but is in two parts, viz. FIG. 11(*a*) and FIG. 11(*b*), wherein FIG. 11(*a*) illustainers using caps which may be of any suitable kind, the machine being adjustable (as will be seen) so that it can handle a wide variety of shapes and sizes of both containers and caps. However, in the particular application illustrated in FIGS. 1 and 2 and others of the Figures, the machine is in use for applying "twist-on, twist-off" metal caps to glass jars filled with a foodstuff.

Figure 1:
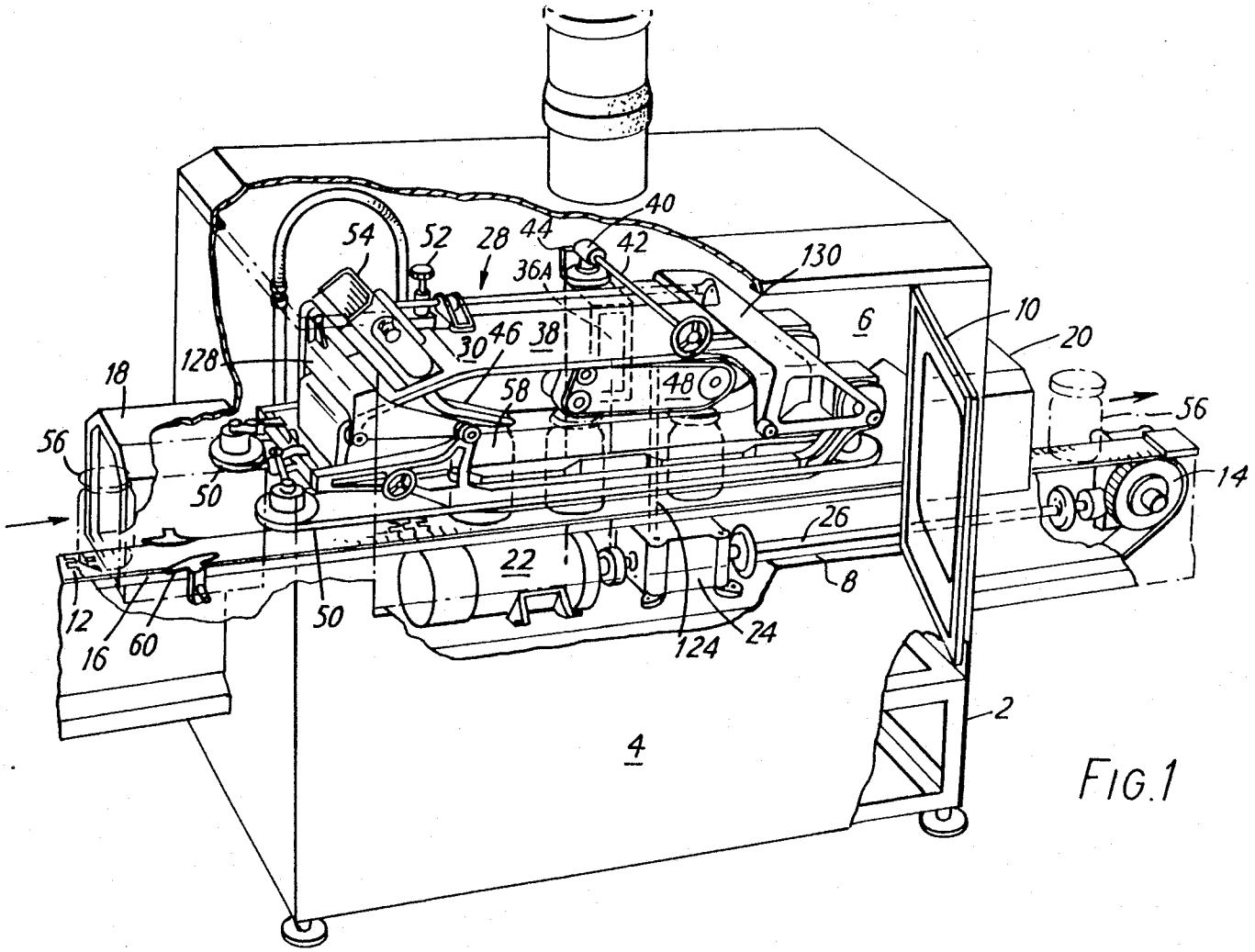
FIG. 1 is a much-simplified, partly cut away, perspective view showing the front of the machine.

The capping machine has a casing comprising a main frame 2 clad with outer panelling 4, to define a working chamber 6, which has a front access opening 8 and a rear access opening not shown. Each of these access openings has doors such as the door shown at 10. The main frame 2 supports a conveyor assembly which extends through the capping machine from one side to the other. The conveyor assembly includes an endless conveyor 12 of the flat-plate type, having at one end a driving drum 14. The conveyor runs on a flat bed 16. At the left-hand and right-hand ends respectively (as seen in FIG. 1) of the machine casing, there are an inlet tunnel 18 and an exit tunnel 20, through which the conveyor 12 passes. Below the conveyor 12, within the casing, is a drive motor 22, coupled to a main gearbox 24 which in turn is coupled, through a conveyor drive shaft 26 having a pair of flexible couplings, to the driving gearbox of the conveyor driving drum 14.

A capping head 28 is arranged within the working chamber 6, over the conveyor 12. The capping head 28 has an anodised aluminium body 30 which comprises a horizontal top portion 29, bent to form an apron portion 32 at the left-hand (inlet) end of the head. At the front and back of the body 30 at the right-hand (exit) end, a pair of integral wing portions, bent downwardly to form flanges 34 extend outwardly from the top portion 29. From the rear of the top portion 29, an integral mounting bracket 31 extends downwardly.

Figure 3:
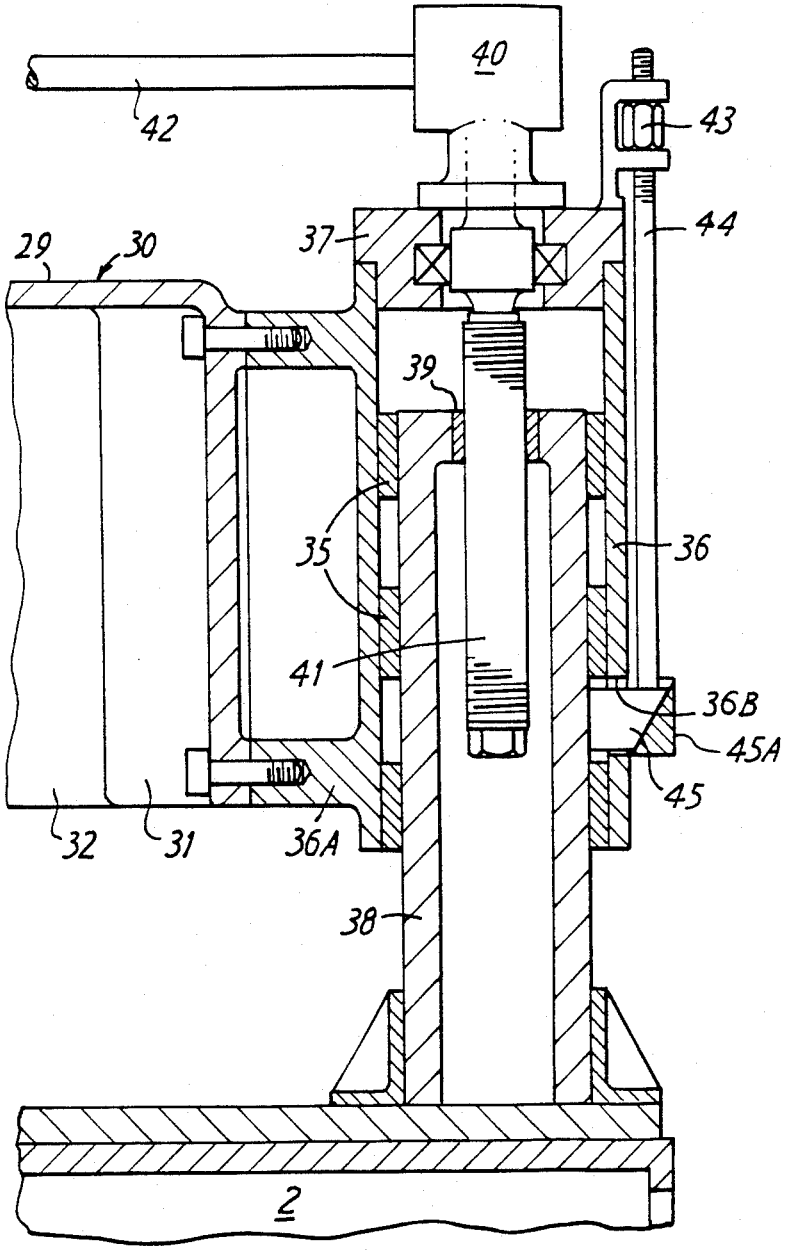
FIG. 3 is a transverse sectional elevation, taken on the line III—III in FIG. 9, showing how the capping head is mounted on a base of the machine.
Figure 9:
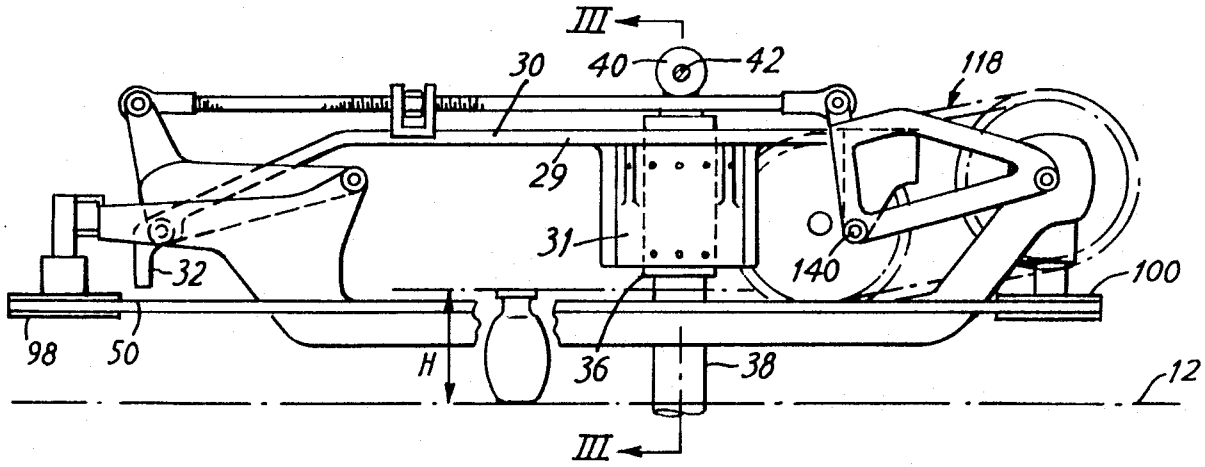
FIG. 9 is a view corresponding to parts of FIG. 8 but shows the side belts in their uppermost position.

Referring to FIGS. 3 and 9, a fixed, upstanding capping head mounting post 38 is secured to the main frame 2 of the machine. A post housing 36 comprises a generally-cylindrical portion mounted coaxially on the post 38 and slidable vertical on the latter. The post housing 36 also has an integral, forwardly, extending portion 36A; the mounting bracket 31 of the capping head body is rigidly secured to the portion 36A so that the head body 30 is cantilevered from the post housing 36 and supported thereby. This is the only means of support of the capping head body.

The facility for sliding vertical movement of the post housing 36 on the post 38 is provided for the purpose of adjusting the head height, i.e. the height at which the capping head 28 is positioned above the conveyor 12. This adjustment is made by means of a leadscrew 41 which is mounted rotatably in an upper closure plate 37 of the post housing and which is rotatable by means of a handwheel (FIG. 1) and shaft 42, through a head height adjusting gearbox 40 mounted on the upper closure plate 37. The shaft 42 is supported in a bearing (not shown) carried by the head body 30 behind the handwheel. The leadscrew 41 engages in a threaded bush 39 secured in the top of the post 38.

housing 36, to prevent any vertical movement of the capping head taking place due to accidental rotation of the leadscrew 41 (which could for example occur as a result of either inadvertent operation of the handwheel on the shaft 42, or mechanical vibration). The locking device comprises a long, slender locking pin 44 which has a threaded portion carried by a release nut 43, the latter being captive on the head housing 36. The pin 44 extends downwardly from the nut 43 and carries at its lower end a wedge member 45 having a vertical face for frictional locking engagement with the post 38. The wedge member 45 also has an inclined face engaging a fixed cam element 45A which is part of the post housing 36. The wedge member extends through a slot 36B formed in the side of the post housing. Rotation of the adjusting nut 43, such as to raise the locking pin 44, releases the wedge member from frictional locking engagement between the cam element 45A and post 38, thus allowing the capping head 28 to be raised or lowered.

Mounted on the capping head body 30, at the inlet end, is a cap heating tunnel 54 provided with means, not shown, for preheating the caps before the latter are delivered to the containers to be closed. An inclined cap feed chute extends downwardly through the tunnel 54 from a suitable supply chute, not shown, which extends through an opening in a portion of the roof of the machine casing 4 that is cut away in FIG. 1. The lower part 46 of the cap feed chute comprises an assembly which is indicated diagrammatically in FIG. 1 and shown in more detail in FIG. 2 and FIGS. 4 to 7. This assembly 46 will be referred to hereinafter simply as the "cap chute". It will be described more fully hereinafter.

Forward of the cap chute 46 is a sealing head assembly 48, carried by the capping head body 30. A pair of endless side belts 50 are carried, one either side of the capping head, by the sealing head assembly which will be described hereinafter.

During the capping operation, a vacuum (as hereinbefore explained) is maintained in the region below the capping head body 30 by suitable means, being controllable by a main vacuum control valve 52, FIG. 1, mounted on top of the body 30. The vacuum and the means for creating and maintaining it can be conventional; they form no part of the present invention, and no further discussion of these aspects will be undertaken herein.

In operation, filled jars 56 are carried by the conveyor 12 through the inlet tunnel 18 into the working chamber 6, in which each jar first receives a cap, placed upon it at the placement or pick-up position 58 by the cap chute 46. The cap is then secured and sealed upon the jar by the sealing head assembly 48, before being carried out of the working chamber through the exit tunnel 20. Each jar is centralised on the conveyor 12 by a pair of adjustable guides 60, FIG. 1, overlying the conveyor in the inlet tunnel 18. Immediately after this, the jars are engaged by the side belts 50 which maintain the jars in their straight central path throughout the capping process.

Referring now to FIGS. 4 to 7, the cap chute 46 comprises a pair of cap support rails 62, of gradually decreasing inclination to the horizontal in the usual manner. Each cap support rail 62 has a side wall 64 and a cap-supporting portion 65, the side walls 64 being spaced apart by slightly more than the diameter of a cap. The final section 65A of each of the cap-supporting portions 65 is narrower than the remainder of the portion 65 upstream of the section 65A, so as to provide a suitable gap (indicated at 66 in FIG. 4) for the passage of the necks of the successive jars through the gap 66.

Figure 6:
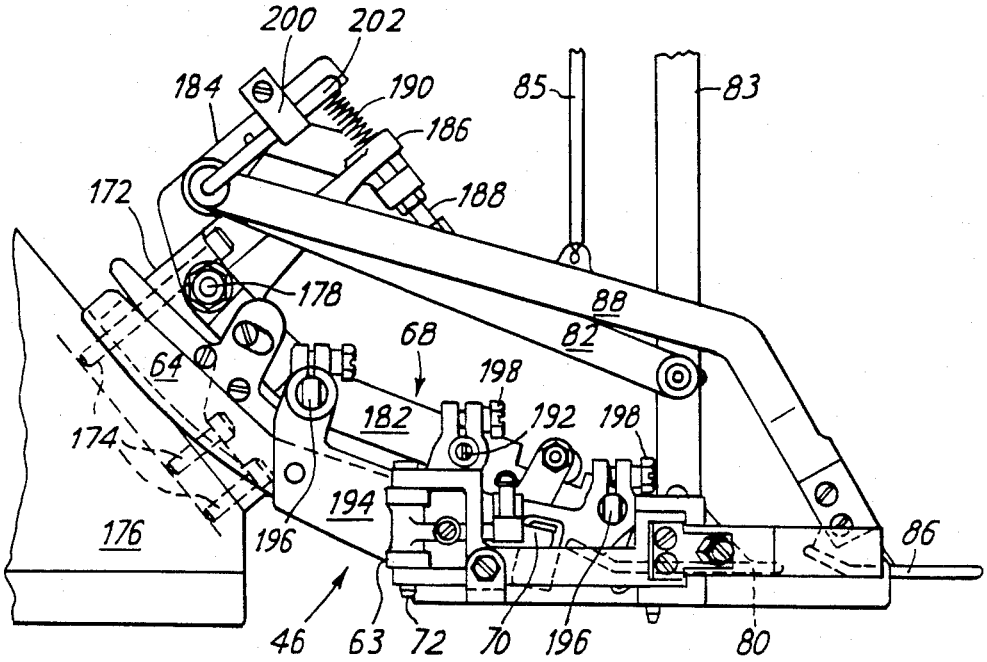
FIG. 6 is a side elevation of the lower part of the cap chute in greater detail.
Figure 7:
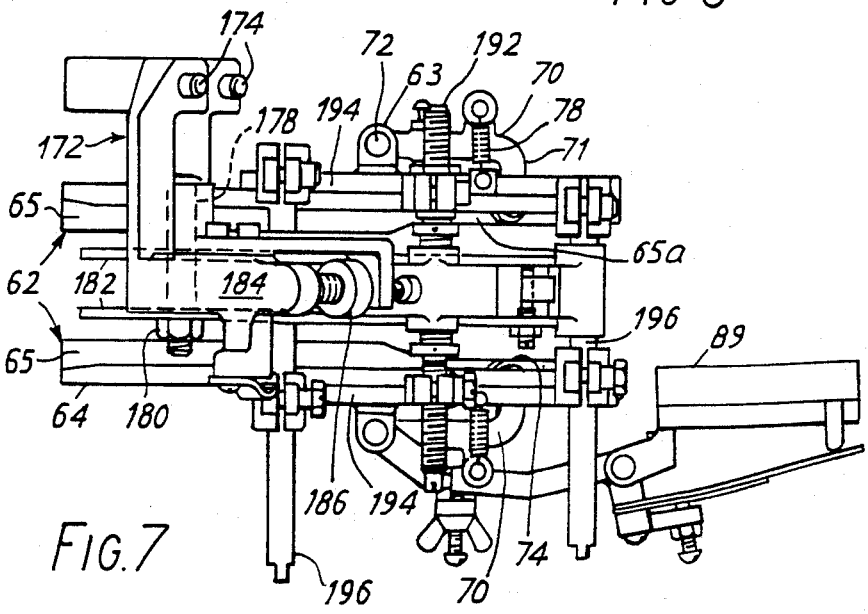
FIG. 7 is a plan view of the same with certain parts omitted.

Referring particularly to FIGS. 6 and 7, the cap chute is adjustably mounted on a portion 176 (FIG. 6) of the capping body 30, in the following manner. Secured by studs 174 to the body portion 176 is a mounting back 172 carrying a transverse pivot pin 178 which passes through a bifurcated centre beam 182 of the cap chute. In this way the latter is hung from the mounting block 172. The pin 178 carries a nut 180 securing the cap chute to the block 172. Upon removal of the nut, the whole cap chute 46 can be withdrawn for maintenance, replacement or other purposes. The mounting block also includes a bracket 184 associated with an adjustment lever 186 which is fixed to the cap chute centre beam 182. The bracket 184 carries an adjusting screw 188 whereby the spacing between the lever 186 and bracket 184, maintained by a compression spring 190, is adjustable when the pivot pin nut 180 is loosened. In this manner the altitude of the cap chute is adjustable to obtain the required angle of the cap chute section 65A to the horizontal, for feeding the caps 76 to the jars.

The centre beam has a width-adjusting shaft 192 mounted through the beam; the shaft 192 has opposed left- and right-hand screw threaded portions, each in screw-threaded engagement with a suitable bracket portion of a respective one of two cap chute side plates 194, so that when the shaft 192 is rotated the side plates are moved towards or away from each other. A pair of stretchers 196 provide the main means for securing the side plates 194 together by means of clamping screws 198, the latter being released to allow the width between the side plates to be altered when necessary.

Each cap support rail 62 is fixed to the adjacent one of the side plates 194. It can be seen from the foregoing how the rails 62 are mounted so as to be readily adjustable both for transverse width between them, so that the cap chute can be re-set to accommodate caps of different diameters; and for the optimum altitude in a vertical plane.

Figure 4:
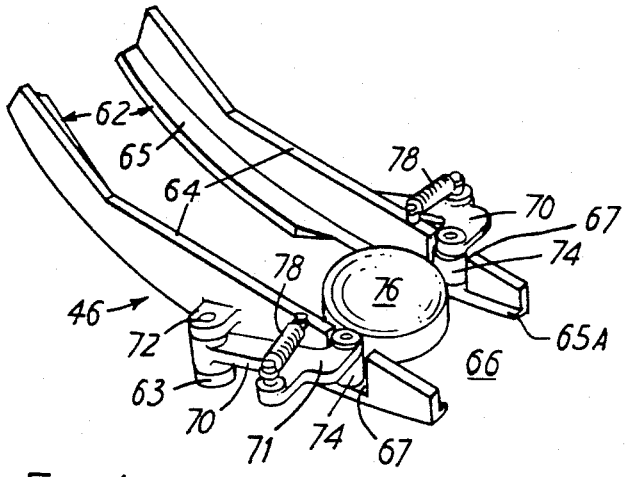
FIG. 4 is a simplified view of the lower part of the cap chute of the same machine, showing a cap at the pick-up position.

Each support rail side wall 64 has on its outer surface a mounting bracket 63 carrying a pivot 72 whereby the rear end of a cap stop roller arm or lever 70 is pivoted about a vertical axis. The roller arms 70 extend fowardly for some distance, the forward end portion 71 of each arm being directed inwardly through an aperture 67 in the side wall 64; at the free end of the end portion 71, each roller arm carries a cap stop roller 74, which is freely rotatable about its own axis. The axes of the stop rollers 74 are so orientated as to lie parallel to each other and substantially parallel to the axis of a cap 76 when the latter is lying, as shown in FIG. 4, with its skirt engaging the two stop rollers. In this position, each cap in turn is arrested by the rollers 74 in its gravity-induced slide down the cap chute; in this position also, the cap becomes engaged by its jar 56 for the first time. For the purpose of arresting the cap, the stop rollers 74 overlie the final section 65A of the cap-supporting rail portions 65, the rollers protruding through the apertures 67. They are biassed towards this normal position by tension springs 78 connected between the respective roller arms 70 and the associated side walls 64. The springs 78 are mounted on top of the respective side walls 64, in an exposed position in which they are readily available for inspection and, if necessary, replacement.

Attached by a spring clip 200 to the mounting block bracket 184 is a pin 202 on which one end of a pair of arms 82 and 88 are freely pivoted. The other end of the arm 82 is pivoted to a vertical push rod 83 carrying a rear presser foot 80. The other end of the arm 88 carries a forward presser foot 86; the arm 88 is pivoted about half-way along its length to a vertical push rod 85. The presser feet and their linkages are omitted for clarity from FIG. 7.

Figure 5:
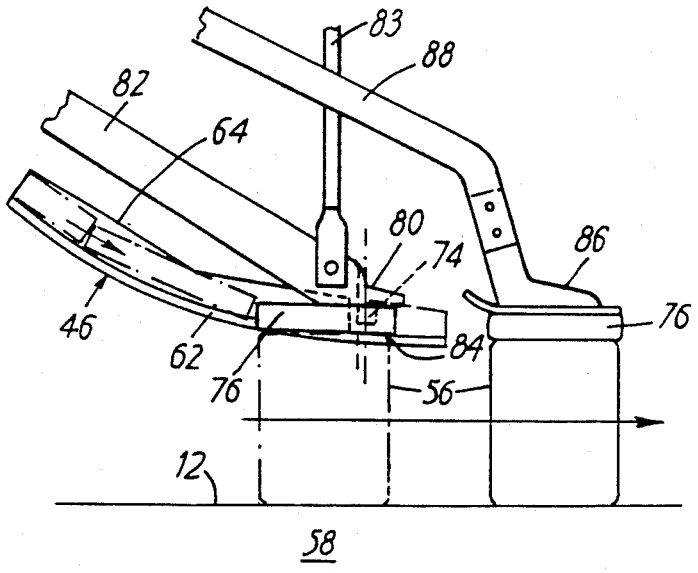
FIG. 5 is a very diagrammatic side elevation showing the lower part of the cap chute and certain components associated therewith, and illustrating the placement of a cap upon a container.

The operation of placing a cap 76 upon a jar 56 at the pick-up station 58 is illustrated in FIG. 5, in which the cap is indicated, in the same position as in FIG. 4, by full lines. Behind it there are indicated in phantom lines, some following caps in the cap chute, awaiting their turn for placement. The cap 76 at the pick-up station is held down against the cap-supporting portions 65 of the rails 62 by the rear presser foot 80. The pressure exerted on the cap 76 by the presser foot 80 is adjustable, through the push rod 83, by means of an adjustor 92 (FIG. 2) mounted on top of the body 30. When the jar 56 arrives below the cap 76 at the pick-up station (as indicated by phantom lines in FIG. 5), the leading portion 84 of the lip around the mouth of the jar engages the corresponding portion of the inner surface of the cap skirt in the usual way. Continued forward movement of the jar (caused by the conveyor 12 and the side belts 50, which are all moving at exactly the same forward speed) causes the jar to push the cap forward, the stop rollers 74 retracting away from each other against the tension springs 78. However, so long as some part of the cap skirt is interrupting the transverse path of the stop rollers between their retracted and normal positions, the cylindrical faces of the rollers 74 roll upon, and apply pressure to, the cap skirt, so maintaining its axial orientation. Thereafter, the rear portion of the cap skirt falls on to the top of the jar. Immediately after the cap has left the cap chute, it is restrained laterally by resilient side guides 89 carried by the cap chute side plates 194 (FIGS. 2, 6 and 7), and axially by the forward presser shoe 86. The axial pressure exerted by the forward presser shoe 86 upon the cap 76 is adjustable in the same manner as that exerted by the rear presser shoe 80, as described above, by a similar adjuster 90 (FIG. 2) acting through the push rod 85.

Figure 2:
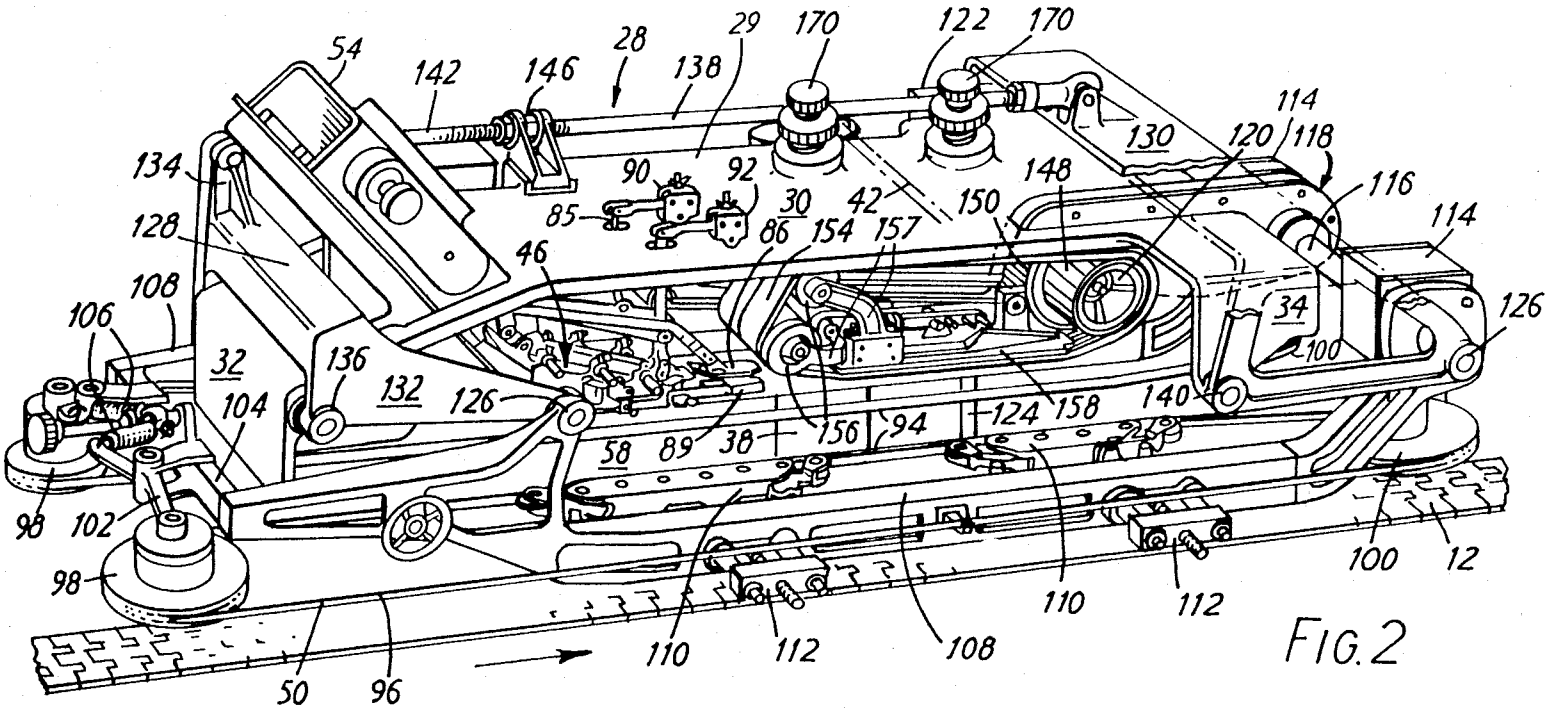
FIG. 2 is an enlarged version of part of FIG. 1, showing in particular the capping head of the machine, still somewhat simplified for clarity but in greater detail than FIG. 1.
Figure 8:
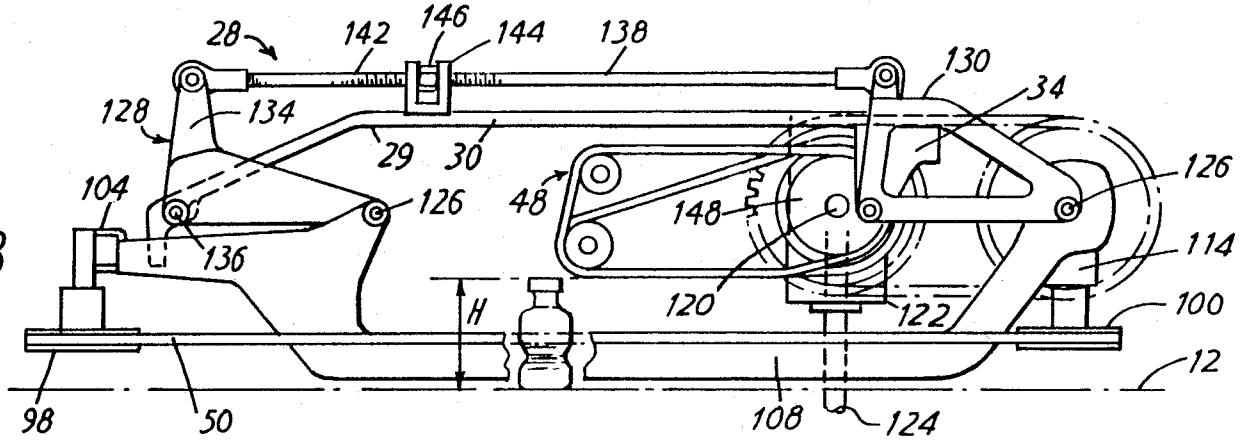
FIG. 8 is a simplified side elevation of the capping head, illustrating in particular the manner in which the side belts of the capping machine are mounted and operated, the side belts being shown in their lowermost position.

Reference is now made to FIGS. 2, 8 and 9. Each endless side belt 50, presenting a working or jar-engaging portion 94 and an outer or idle portion 96 (FIG. 2) is carried by a pair of side belt pulleys 98,100, one at each extreme end of the capping head. The rear side belt pulleys 98 are freely rotatable, on vertical axes, at the ends of support arms 102 which are pivoted to a cross-beam 104. The support arms 102 are biassed by side belt tensioning springs 106. The cross-beam 104 is fixed at each of its ends to the rear end of a respective one of a pair of side belt frames or support beams 108 extending along the capping head at either side of the latter. Each support beam 108 carries a plurality of side belt locating shoes 110 along which the working portion 94 of the side belt runs.

In this example, there are two locating shoes 110 to each support beam 108. The locating shoes 110 at each side of the capping head serve to maintain the working portion 94 of the respective side belt in a straight configuration and at the correct transverse distance from the working portion of the other belt 50. With this in view, the transverse distances of the locating shoes 110 from their side belt support beams 108 are adjustable by means of suitable adjusters 112, FIG. 2.

The leading side belt pulleys 100 are each carried by a respective side belt pulley gearbox 114 fixed to the front end of the corresponding support beam 108. The pulley gearboxes 114 are coupled together by a transverse final drive shaft 116 which is driven by a chain drive 118 from a main driven shaft 120. The shaft 120 is cantilevered from a spiral-bevel gearbox 122 mounted at the back of the capping head body 30. The gearbox 122 is driven by a vertical main drive shaft 124 which is, in turn, driven by the main gearbox 24, so that the driven shaft 120 and the side belts 50 are all driven, in synchronism with the conveyor 12, by the motor 22.

The manner in which the side belt support beams 108 are mounted in the capping head will now be described. Each beam 108 carries two pivots 126, one near each end of the beam. These four pivots lie in a common horizontal plane which is parallel with the top of the conveyor 12. Pivoted at the pivots 126 to the beams 108, and thus connecting the latter together transversely, are two rigid cross-members 128,130. The rearward cross-member 128 has a transversely-extending portion joining a pair of side crank portions 132,134, each of which carries the appropriate element of the respective pivot 126 and is also pivoted about a transverse axis (common to the pivots of both crank portions) to the capping head body 30 as indicated at 136. The rear crank portion 134 has an upstanding portion to which is pivoted one end of a horizontal tie bar 138.

The forward cross-member 130 also comprises a transversely-extending portion joining a pair of side crank portions, each pivoted to the beam 108 by the respective pivot 126 and also being pivoted to the capping head body 30 about a transverse axis at 140. The axes 136 and 140 lie in a common horizontal plane which is again parallel to the top of the conveyor 12.

The front end of the horizontal tie bar 138 is pivoted to the transverse portion of the forward cross-member 130. The tie bar 138 has a threaded portion 142, which passes through a U-shaped bracket 144 secured to the top of the capping head body 30. An adjusting nut 146 is threaded on to the portion 142 and held captive in the bracket 144.

It will now be seen that the side belt support beams 108 are carried in the capping head by a parallelogram-type linkage comprising the beams themselves as lower horizontal members, the tie bar 138 as the upper horizontal member, and, as the side members, the cross members 128 and 130. By reference to FIG. 9 and comparison between FIGS. 8 and 9, it will also be readily seen that the vertical distance between the side belts 50 and the top of the conveyor 12 (the "side belt height") is infinitely adjustable within a predetermined range by simply turning the nut 146 by means of a spanner, so as to move the tie bar 138 to the right (as seen in FIGS. 8 and 9) to lower the side belts, and to the left in order to raise them.

The use of the chain drive 118 enables this adjustment to be made without disturbing the motion of the side belts 50.

FIGS. 8 and 9 show two containers of different shapes on the conveyor 12, each container having a cylindrical portion in a different position, and the side belts being adjusted in each case to engage that cylindrical portion.

Referring now to FIG. 10, the sealing head assembly comprises a pair of sealing belt drums 148, 150, of slightly different diameters, carried by the main driven shaft 120 already described, and therefore rotated continuously in synchronism with the conveyor 12 and the side belts 50. A pair of endless sealing belts 152,154 extend around the respective drums 148,150 and around respective, rearwardly-disposed, idler pulleys 156. The pulleys 156 are carried by brackets 157 (FIG. 2) which are carried, via a spring-tensioning device, not shown, to maintain tension in the belts 152 and 154, by a sealing shoe 158. The brackets 157 are omitted from FIGS. 10 and 11 for clarity. The sealing shoe 158 extends generally horizontally and has a flat lower surface overlying, and in contact with, the lower runs of both of the sealing belts 152 and 154.

The sealing shoe is pivoted to the forward end of each of a forward suspension arm 160 and a rearward suspension arm 162. Both of these suspension arms are pivoted, at their rear ends 164, to the capping head body 30. (These pivots are out of sight in FIG. 2). To each of the suspension arms 160 and 162, adjacent to the pivot with the sealing shoe 158, there is pivoted a respective one of a pair of vertical hanger rods 166, each of which is suspended by its top end, through a compression spring 168, from the capping head body 30. The springs 168 cause the sealing shoe 158 to exert upon the caps 76, through the sealing belts 152 and 154, the axial force necessary to secure the caps to the jars 56. This force is adjustable by means of spring adjusters 170 (FIG. 2) incorporated in the mountings of the compression springs 168. At the same time, because of the difference between the diameters of the sealing belt drums 148 and 150, the belts 152 and 154 are driven at different speeds, and so impart a rotational movement to the caps 76 in contact therewith. In this manner, whilst the axial downward force is exerted by the sealing shoe 158, the caps 76 are secured sealingly to their jars 56.

FIG. 11(*a*) illustrates by a heavy arrow the upward reaction force, compressing the rear spring 168, imposed upon the sealing head assembly when a container, carrying a cap, initially arrives under the sealing shoe; whilst FIG. 11(*b*) illustrates by a similar arrow the reaction force when the capped container is about to pass from below the sealing shoe. It should be noted that in both cases, it is assumed that no other container lies under the sealing head assembly; such a case is however illustrated in FIG. 10, in which both of the springs 168 are compressed. Thus the downward tilt of the front or rear end of the sealing head assembly, evident in FIGS. 11(*a*) and (*b*) respectively, is absent from FIG. 10.

We claim:

1. A capping machine for applying removable closure members to containers and including container-advancing means for moving the containers in succession in a generally-horizontal, longitudinal forward direction, the machine having container support means for supporting the containers thereon during their forward movement, and a capping head above the container support means, the capping head having a body and including also a pair of elongate, longitudinally-extending side support members for engaging the containers between them during the said forward movement, wherein the capping head includes a parallelogram-type structure comprising a lower longitudinal portion including the side support members, a pair of end portions each pivoted to the lower longitudinal portion and each pivotally mounted on the capping head body about a transverse axis, and an upper longitudinal portion pivotally connected to and between the end portions, the capping head further including securing means for securing the parallelogram-type structure in a predetermined altitude with respect to the capping head body, and said securing means being adjustable so as to vary at will the said altitude whereby to vary the height of the side support members above the container support means.

2. A machine according to claim 1, including a cap chute comprising a pair of substantially parallel guide rails for supporting each of a succession of the closure members at a pick-up position, there to be engaged by the rim of an open container passing in said forward direction below the cap chute, the guide rails being directed so as to deliver the closure members in the same direction, the cap chute further comprising a pair of rollers for engaging with their peripheries the sides of the cap at the pick-up position, each roller being mounted for free rotation about its axis in a respective roller arm, and each roller arm being mounted by a pivot at the side of the respective guide tail such that a plane common to the lever arm pivot and the roller axis makes a relatively small acute angle with the direction of forward motion of the closure members, each roller being biassed by a tension spring towards the other roller such that the rollers together constitute a retractable stop for each successive closure member.

3. A machine according to claim 1 or claim 2, including means for delivering closure members in succession to place them upon the containers without securing them, the capping head including sealing means for subsequently securing each closure member in turn to its container, the sealing means being adapted to apply downward sealing pressure upon each of a succession of the closure members previously placed upon a respective container, the sealing means comprising a sealing shoe which is carried by a pair of suspension arms extending generally in said longitudinal direction and arranged one behind the other in that direction, each suspension arm being pivoted at one end to the capping head body and at the other end to the sealing shoe and being in addition suspended from the capping head body through individual resilient load-applying means connected so as to apply a substantially vertical load to the suspension arm at a point offset longitudinally from the pivot joining the arm to the sealing shoe, whereby the sealing shoe can rock longitudinally under the control of the load-applying means.

4. A machine according to claim 1 or claim 2, including a machine base having container support means for supporting the containers thereon during their forward movement, and a capping head mounted on the base and arranged above the container support means, the capping head having a body, wherein the capping head body is cantilevered from a single support post mounted on the machine base, the body being movable along the support post so as to vary the height of the capping head above the base, and having locking means to lock it to the support post at any predetermined height, other means mounting the capping head on the base being absent.

5. A machine according to claim 1 or claim 2, including means for delivering closure members in succession to place them upon the containers without securing them, the capping head including sealing means for subsequently securing each closure member in turn to its container, the sealing means being adapted to apply downward sealing pressure upon each of a succession of the closure members previously placed upon a respective container, the sealing means comprising a sealing shoe which is carried by a pair of suspension arms extending generally in said longitudinal direction and arranged one behind the other in that direction, each suspension arm being pivoted at one end to the capping head body and at the other end to the sealing shoe and being in addition suspended from the capping head body through individual resilient load-applying means connected so as to apply a substantially vertical load to the suspension arm at a point offset longitudinally from the pivot joining the arm to the sealing shoe, whereby the sealing shoe can rock longitudinally under the control of the load-applying means, the machine further including a machine base having container support means for supporting the containers thereon during their forward movement, and a capping head mounted on the base and arranged above the container support means, the capping head having a body, wherein the capping head body is cantilevered from a single support post mounted on the machine base, the body being movable along the support post so as to vary the height of the capping head above the base, and having locking means to lock it to the support post at any predetermined height, other means mounting the capping head on the base being absent.

6. A machine according to claim 1, wherein the upper longitudinal portion of the parallelogram-type structure is a tie member secured by the securing means to the capping head body.

7. A machine according to claim 6, wherein the tie member is a simple tie bar having a threaded portion, the securing means comprising a threaded member engaged around said threaded portion and restrained longitudinally by locating means fixed to the capping head body, whereby the said height is variable by simple rotation of the threaded member.

8. A machine according to claim 1, wherein the lower longitudinal portion of the parallelogram-type structure comprises a pair of longitudinal beams spaced transversely apart at either side of the capping head body.

9. A machine according to claim 8, wherein each side support member comprises an endless side belt, the lower longitudinal portion of the parallelogram-type structure carrying at its ends pulleys for said side belts, the machine further including side belt drive means for driving the side belts in a direction such as to urge the containers forward through the machine.

10. A machine according to any one of claims 1, 6, 7 or 8, wherein each side support member comprises an endless side belt, the lower longitudinal portion of the parallelogram-type structure carrying at its ends pulleys for said side belts, the machine further including side belt drive means for driving the side belts in a direction such as to urge the containers forward through the machine, the container support means being a linear conveyor, the side belt drive means being coupled with drive means of the linear conveyor so that the side belts and the linear conveyor move forward at the same speed as each other.

11. A capping machine according to claim 1, including a cap chute comprising a pair of substantially parallel guide rails for supporting each of a succession of the closure members at a pick-up position, there to be engaged by the rim of an open container passing in a forward longitudinal direction below the cap chute, each guide rail forming a lateral aperture rearward of a front end of the guide rail, the cap chute further comprising a pair of rollers extending through the lateral apertures formed by said guide rails for engaging the sides of the closure members with the peripheries of the rollers to releasably retain the closure members on the cap chute at a position rearward of the front ends of the guide rails and where the open containers first engage the closure members, each roller being mounted for free rotation about its axis on a respective roller arm, and each roller arm being mounted by a pivot at the side of a respective one of the guide rail such that a plane common to the roller arm pivot and the roller axis makes a relatively small acute angle with the direction of forward motion of the closure members, each roller being biased by a tension spring toward the other roller such that the rollers together constitute a retractable stop for each successive closure member.

12. A capping machine according to claim 11, wherein the rollers, roller arms and tension springs are exposed so as to be replaceable without disturbance to the remainder of the cap chute.

13. A capping machine according to claim 11 or claim 12, wherein the guide rails are mounted by spacing means adjustable so as to vary the transverse distance between the guide rails.

14. A capping machine for applying removable closure members to containers, comprising container-advancing means for moving the containers in succession in a generally-horizontal, longitudinal forward direction, means for delivering closure members in succession to place them upon the containers without securing them, and a capping head having a body and including sealing means for subsequently securing each closure member in turn to its container, the sealing means being adapted to apply downward sealing pressure upon each of a succession of the closure members previously placed upon a respective container, the sealing means comprising a sealing shoe which is carried by a pair of suspension arms extending generally in said longitudinal direction and arranged one behind the other in that direction, each suspension arm being pivoted at one end to the capping head body and at the other end to the sealing shoe and being in addition suspended from the capping head body through individual resilient load-applying means connected so as to apply a substantially vertical load to the suspension arm at a point offset longitudinally from the pivot joining the arm to the sealing shoe, whereby the sealing shoe can rock longitudinally under the control of the load-applying means.

15. A machine according to claim 14, wherein the means for delivering closure members is a cap chute comprising a pair of substantially parallel guide rails for supporting each of a succession of the closure members at a pick-up position, there to be engaged by the rim of an open container passing in said forward direction below the cap chute, the guide rails being directed so as to deliver the closure members in the same direction, the cap chute further comprising a pair of rollers for engaging with their peripheries the sides of the cap at the pick-up position, each roller being mounted for free rotation about its axis in a respective roller arm, and each roller arm being mounted by a pivot at the side of the respective guide rail such that a plane common to the lever arm pivot and the roller axis makes a relatively small acute angle with the direction of forward motion of the closure members, each roller being biassed by a tension spring towards the other roller such that the rollers together constitute a retractable stop for each successive closure member.

16. A machine according to claim 14, wherein each suspension arm is pivotally attached at its leading end to the sealing shoe.

17. A machine according to claim 14, wherein the point of connection to each suspension arm of the load-applying means is substantially nearer to the pivot of the former with the sealing shoe than to its pivot with the capping head body.

18. A machine according to claim 14, wherein each of the resilient load-applying means comprises a compression spring coupled through a substantially vertical hanger with the respective suspension arm, to which the hanger is pivoted at said point of connection.

19. A machine according to claim 14, wherein the sealing means includes differential belt drive pulley means arranged to be driven about an axis fixed with respect to the capping head body, a pair of endless sealing belts engaging the drive pulley means and appropriate idler pulley means so as to be driven by the drive pulley means at different speeds with a lower course of each sealing belt engaging the top of the closure member, so as to rotate the closure member about its axis in a securing direction, the sealing shoe overlying the lower courses of the sealing belts to apply downward pressure through the latter to the closure member, and the idler pulley means being carried by the sealing shoe.

20. A capping machine for applying removable closure members to containers and including container-advancing means for moving the containers in succession in a generally-horizontal, longitudinal forward direction, a machine base having container support means for supporting the containers thereon during their forward movement, and a capping head mounted on the base and arranged above the container support means, the capping head having a body cantilevered from a single support post mounted on the machine base, the body being movable along the support post so as to vary the height of the capping head body above the base, and having locking means to lock the capping head body to the support post at any predetermined height, the locking means including a support post housing slidable along the support post, a wedge extending into support post housing and movable axially therein between a free position and a locking position in which the wedge is forced into intimate locking engagement with the support post, and means for moving the wedge between, and retaining it in, its said positions.

21. A machine according to claim 20 wherein the capping head body is secured to the support post housing and cantilevered therefrom, and the support post housing is connected to the support post by means of an axial leadscrew carried by the former and provided with actuating means for rotating the leadscrew so as to raise and lower the capping head.

* * * * *